US008127500B2

(12) United States Patent
Meeks et al.

(10) Patent No.: US 8,127,500 B2
(45) Date of Patent: Mar. 6, 2012

(54) ENTRY SYSTEM WITH WATER INFILTRATION BARRIER

(75) Inventors: James W. Meeks, Eaton, OH (US); Michael Braun, Fort Wayne, IN (US)

(73) Assignee: Therma-Tru Corp., Maumee, OH (US)

( * ) Notice: Subject to any disclaimer, the term of this patent is extended or adjusted under 35 U.S.C. 154(b) by 1075 days.

(21) Appl. No.: 11/732,186

(22) Filed: Apr. 3, 2007

(65) Prior Publication Data

US 2007/0227076 A1 Oct. 4, 2007

Related U.S. Application Data

(60) Provisional application No. 60/789,171, filed on Apr. 4, 2006.

(51) Int. Cl.
*E06B 7/16* (2006.01)

(52) U.S. Cl. ..... 49/479.1; 49/476.1; 49/506

(58) Field of Classification Search ..... 49/475.1, 49/479.1, 476.1, 504, 506
See application file for complete search history.

(56) References Cited

U.S. PATENT DOCUMENTS 3,851,420 A * 12/1974 Tibbetts ..... 49/471
4,310,991 A * 1/1982 Seely ..... 49/470
4,726,147 A * 2/1988 Beske et al. ..... 49/406
5,127,193 A * 7/1992 Okada et al. ..... 49/495.1
5,857,291 A 1/1999 Headrick
6,219,971 B1 * 4/2001 Headrick ..... 49/469
6,491,326 B1 12/2002 Massey et al.
6,637,158 B2 10/2003 Bennett
6,665,989 B2 12/2003 Bennett
2002/0035810 A1 * 3/2002 Bennett ..... 52/287.1
2003/0052492 A1 3/2003 Massey et al.
2004/0006938 A1 * 1/2004 Schiffmann et al. ..... 52/211
2004/0139667 A1 7/2004 Massey et al.
2006/0150517 A1 7/2006 Meeks et al.
2007/0079557 A1 4/2007 Pepper et al.
2007/0218270 A1 * 9/2007 Huntress et al. ..... 428/304.4
2008/0010904 A1 1/2008 Meeks et al.

OTHER PUBLICATIONS

Office action from U.S. Appl. No. 12/816,415 dated Dec. 23, 2011.

* cited by examiner

*Primary Examiner* — Gregory J. Strimbu
(74) *Attorney, Agent, or Firm* — Calfee, Halter & Griswold, LLP

(57) ABSTRACT

Entry systems that minimize water infiltration due to a wind driven rain. In one embodiment, the entry system includes a corner pad that includes an upper portion that seals against the weather strip when the door is closed and a lower portion that is spaced apart from the weather strip to form a gap between the lower portion and the weather strip. The lower portion seals against the door when the door is closed.

21 Claims, 6 Drawing Sheets

ENTRY SYSTEM WITH WATER INFILTRATION BARRIER

RELATED APPLICATIONS

This application claims priority from U.S. provisional application Ser. No. 60/789,171 entitled "Entry System With Water Infiltration Barrier," filed on Apr. 4, 2006. U.S. provisional application Ser. No. 60/789,171 is incorporated herein by reference in its entirety.

FIELD OF THE INVENTION

The present invention relates to entry systems, particularly entry doorways which are provided with a corner seal to inhibit water filtration.

BACKGROUND ART

Increased attention is being focused on eliminating or minimizing the water intrusion through entry doors caused by wind driven rain. Referring to prior art FIG. 1, a lower edge 20 of a door 22 can be sealed in a weather tight manner with a sill 24 by a sweep seal 26 mounted on the lower door edge. The vertical junction between the right and left marginal edges of the door face can be sealed to the door jamb by an elongate weather strip 28 affixed to the jamb 30. The right and left lower corners where the sill and door jamb meet form a difficult to seal junction and are a frequent leak site. There have been numerous efforts to seal the door jamb corners. Representative examples of efforts to seal the door jamb corners are shown in U.S. Pat. Nos. 3,851,420; 6,219,971 and 6,665,989.

Rectangular compressible corner pads 32 have been placed on the bottom of the jamb 30 where the jamb meets the sill 24. The rectangular corner pad 32 is compressed between the door 22 and jamb 30 when the door is closed to fill the space between the door and the jamb at the bottom corner of the door, thus inhibiting leakage of water at this location. A portion of the rectangular corner pad 32 extends behind a flexible leg 36 of the weather strip 28. The rectangular corner pad 32 is illustrated in FIGS. 1 and 2 was used by Therma-Tru in this manner at least as early as Aug. 15, 1988. Referring to FIG. 2, the corner pad 32 has a tapered profile with rounded edges. When the door 22 is shut against the weather strip, the weather strip is compressed against the door to form a seal against the door. When the weather strip 28 is compressed, a channel 40 defined by the weather strip is reduced in size.

SUMMARY OF THE INVENTION

The present application discloses embodiments of entry systems that minimize water infiltration due to a wind driven rain. In one embodiment, the entry system includes a corner pad that includes an upper portion that seals against the weather strip when the door is closed and a lower portion that is spaced apart from the weather strip to form a gap between the lower portion and the weather strip. The lower portion seals against the door when the door is closed.

DETAILED DESCRIPTION OF THE PREFERRED EMBODIMENT(S)

While various aspects and concepts of the invention are described and illustrated herein as embodied in combination in the exemplary embodiments, these various aspects and concepts may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, and so on may be described herein, such descriptions are not intended to be a complete or exhaustive list of available alternative embodiments, whether presently known or identified herein as conventional or standard or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

Figure 3:
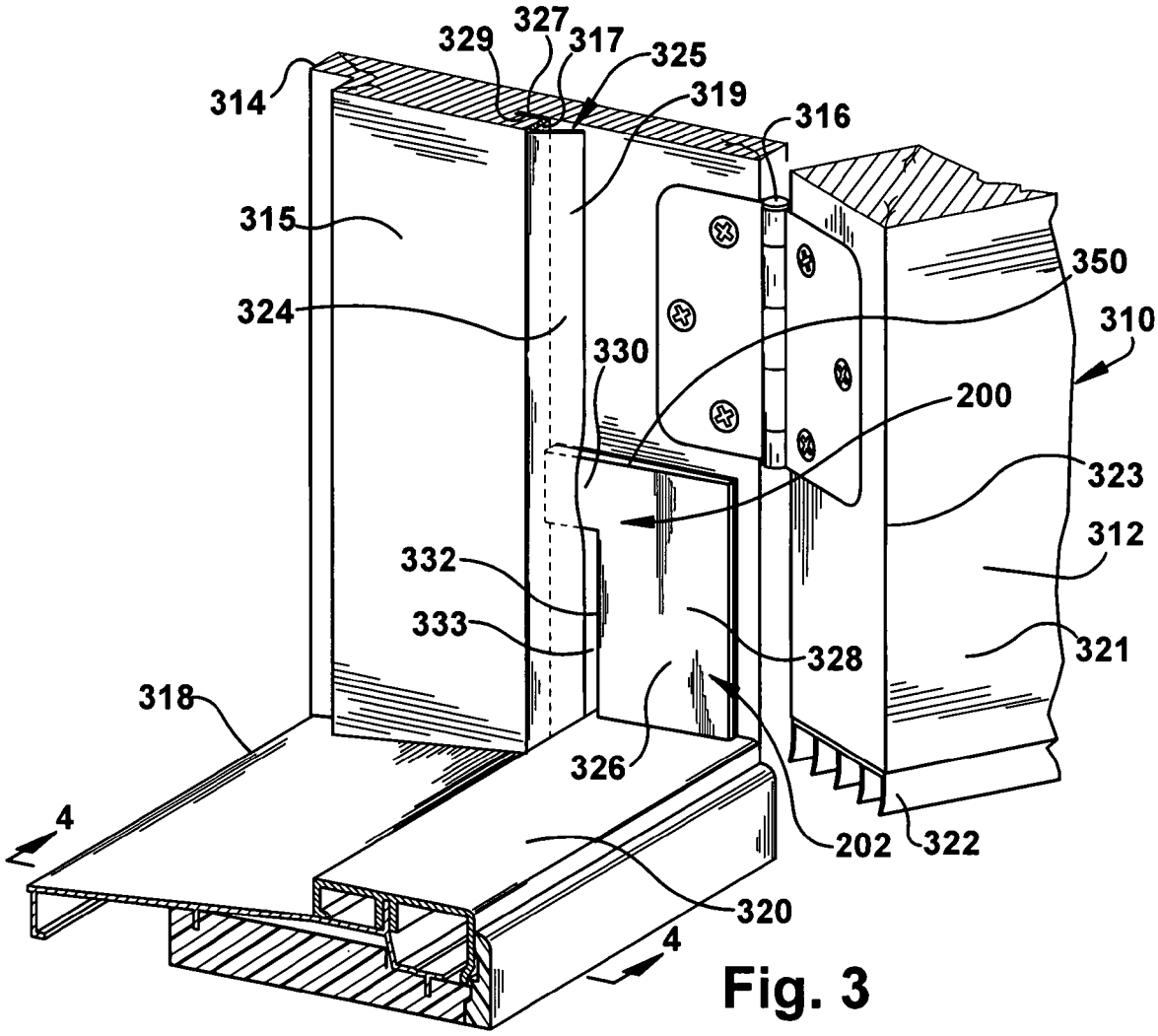
FIG. 3 is a partial perspective view of a lower corner of an entryway system utilizing the present invention.
Figure 4:
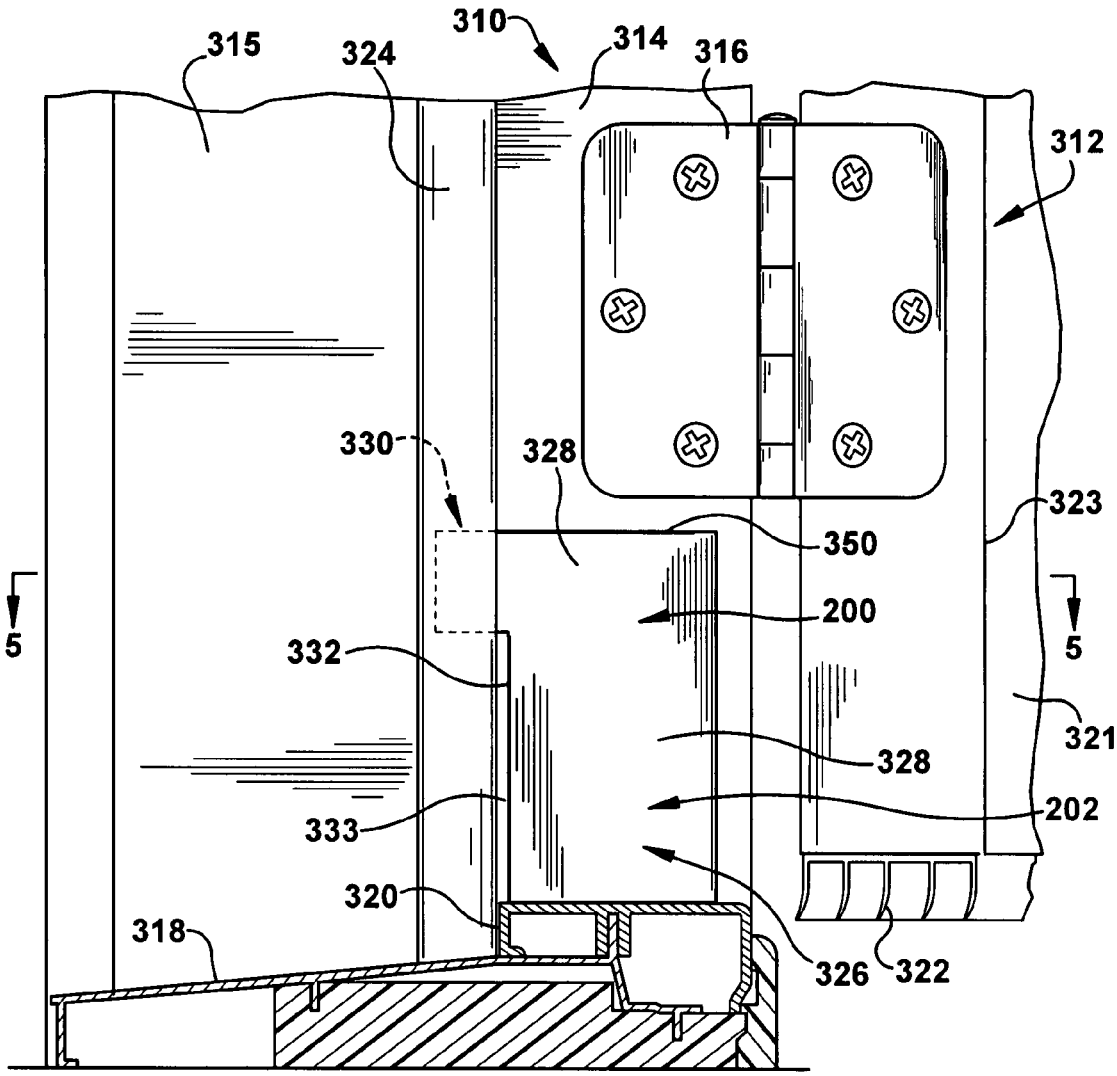
FIG. 4 is a side cross-sectional view of an entryway system taken along lines 4-4 of FIG. 3.
Figure 5A:
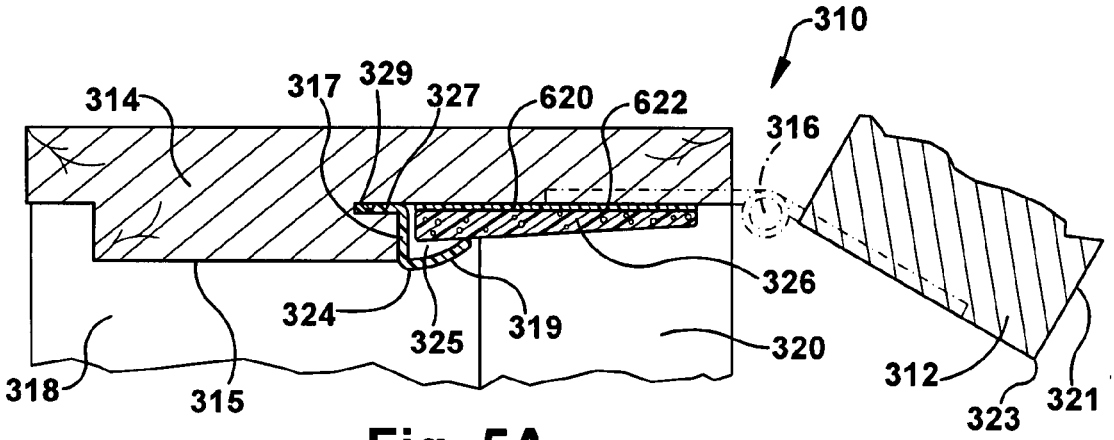
FIG. 5A is a top sectional plan view of the entryway system of FIG. 4 taken along lines 5-5 showing a door in an open position.
Figure 5B:
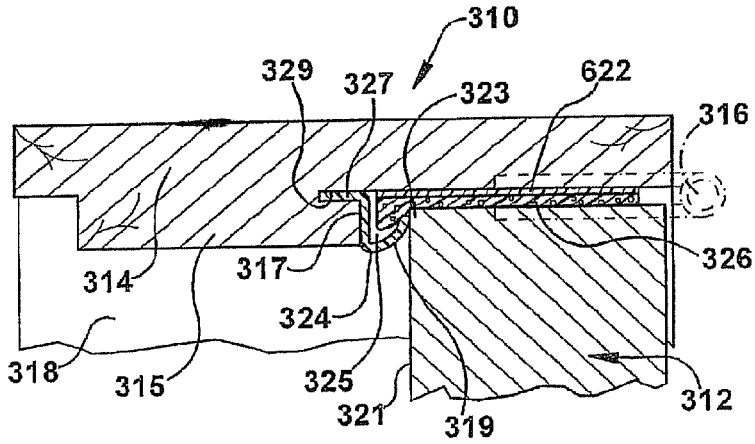
FIG. 5B is a top sectional plan view of the entryway system of FIG. 4 taken along lines 5-5 showing the door in a closed position.

FIGS. 3-5 illustrate a lower corner of an exemplary entryway system 310. In the illustrated embodiment, a hinged door 312 is mounted to a vertical jamb 314 by a conventional hinge 316. The door jamb 314 extends vertically from a sill 318 which is provided with a threshold cap 320 extending from the door jamb 314 to an opposite door jamb (not shown) on the other side of the entryway. The lower marginal edge of door 312 is provided with a sweep seal 322 which sealingly engages the threshold cap 320 when the door is closed. The jamb 314 includes an elongated stop 315. The stop 315 may be integrally formed with the door jamb 314 or the stop 315 may be a separate member that is attached to the door jamb 314. A weather strip 324 is attached to the jamb 314. The illustrated weather strip includes a first leg 317 that is positioned adjacent to the stop 315 and a second, flexible leg 319. A channel 325 is defined between the first leg 317 and the flexible leg 319. The weather strip 324 may be attached to the jamb 314 in a wide variety of different ways. In the illustrated embodiment, the weather strip 324 is attached by a projection 327 of the weather strip that is secured in a recess 329 that is defined between the stop 315 and the jamb 317. The outer face 321 and/or the outer margin vertical corner edge 323 of door 312 sealingly engages the weather strip 324 when the door is in the closed position (See FIG. 5B). A corner seal 326 is affixed to the door jamb 314 and is located immediately atop of the threshold cap 320 in the illustrated embodiment.

In the embodiment illustrated by FIGS. 3-5, the corner seal 326 seal has an upper portion 200 that seals against the weather strip when the door is closed and a lower portion 202 that is spaced apart from the weather strip to form a gap 333 between the lower portion and the weather strip 324. The lower portion 202 seals against the door 312 when the door is closed.

Figure 7A:
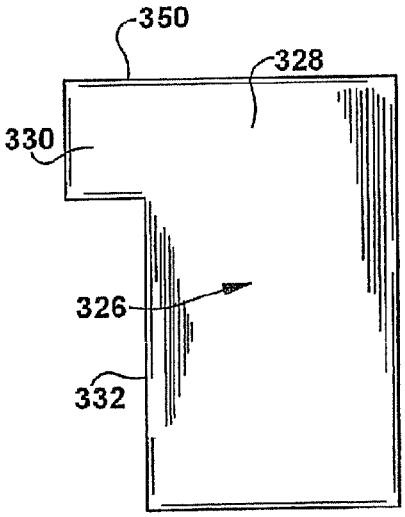
FIGS. 7A and 7B are right and left side elevational views of a pair of corner seals.
Figure 8A:
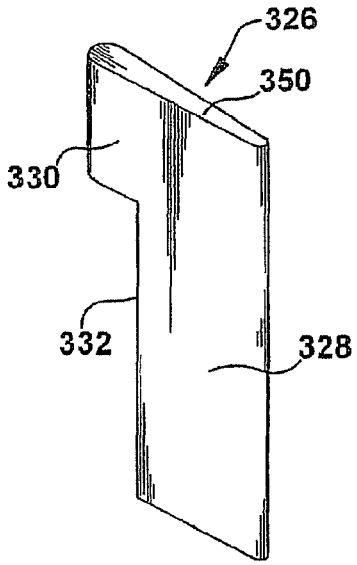
FIGS. 8A and 8B are perspective views of the corner seals illustrated by FIGS. 7A and 7B.

An exemplary corner pad or seal 326 is shown in FIGS. 7A and 8A. The illustrated corner seal 326 is generally shaped like the number "7" or is "L" shaped, depending on the orientation of the seal. The corner seal 326 has a generally, vertically aligned rectangle body 328 with a projection 330 extending therefrom at the upper outer corner. As is clearly shown in FIGS. 3 and 4, projection 330 extends between the vertical jamb 314 and the weather strip 324. Projection 330 cooperates with weather strip 324 to provide a leak tight seal when the door is closed above the level of wind driven rain. In the exemplary embodiment, the projection 330 and the weather strip 324 are pressed together when the door is closed to provide a leak tight seal therebetween. The projection 330 is preferably over 1" above the sill and most preferably 2" to 4" above the sill.

When the door 312 is closed, the channel 325 of the weather strip 324 is reduced in size, creating a small capillary that extends upward along the weather strip. The channel 325 may be reduced to the point that a drop of water can span the channel and wick up the channel by capillary action and/or the water could be forced up the channel by blowing wind. However, an outer marginal edge 332 of corner seal 326 below extension 330 does not extend between the vertical jamb 314 and the weather strip 324, such that the marginal edge 322 is spaced from weather strip 324 when the door is closed forming a gap 333 (See FIG. 4). The gap 333 may be in communication with the channel 325, such that water in the channel 325 can drain into the gap 333. The gap 333 is too large for a drop of water to bridge across in an exemplary embodiment. As a result, water is inhibited from moving up the channel 325 as a result of capillary action. In another exemplary embodiment, the gap 333 is small enough for a drop of water to bridge, but too large for a drop of water to travel up due to capillary action. These designs inhibit wicking or the upward flow of water between the corner seal and the adjacent section of weather strip 324.

The projection 330 also helps to inhibit water from being pushed over a top edge 350 of the corner seal and into the building. The projection 330 eliminates the gap 333 between the corner seal 326 and the weather strip 324 at the top of the corner seal 326. By eliminating the gap 333 at the top of the corner seal, the velocity at which air can travel up the portion of the weather strip that is below the projection is reduced. The velocity is reduced, because the volumetric rate at which air flows past the projection 330 is the same as the volumetric rate at which air flows below the projection and the cross-sectional area through which the air can flow is smaller at the projection 330 (i.e. no gap, the area of channel 325 only) than it is below the projection (i.e. the area of the gap 333 plus the area of the channel 325). The projection also limits air movement up the weather strip to inhibit water from moving up to the top edge 350 by occupying a small portion of the space between the jamb 314 and the weather strip.

Figure 1:
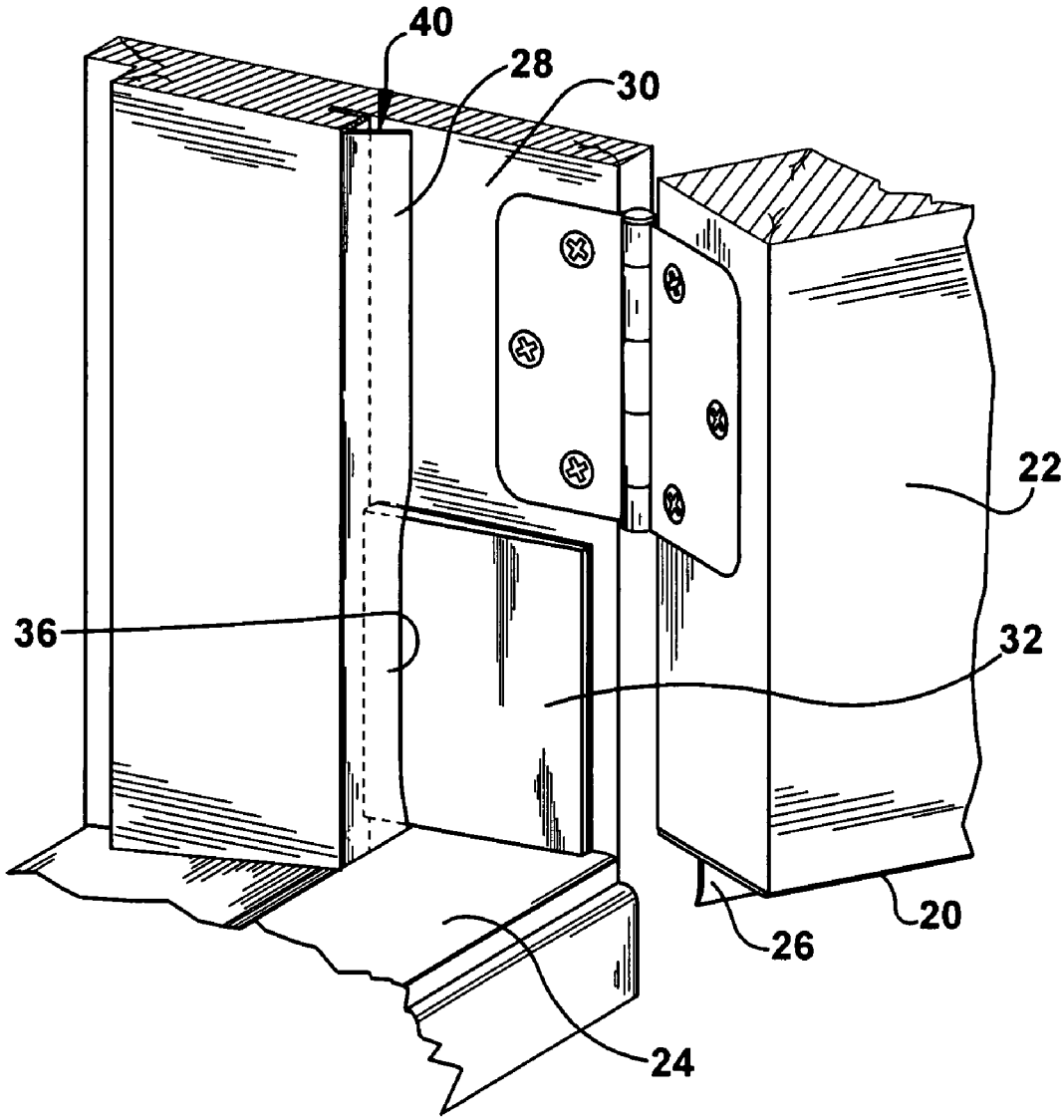
Fig. 1 (PRIOR ART)
FIG. 1 is a partial perspective view of a lower corner of a prior art entryway system.
Figure 2:
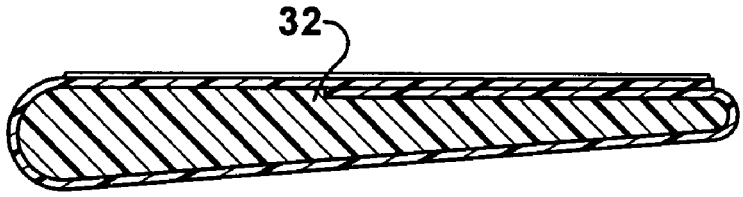
Fig. 2 (PRIOR ART)
FIG. 2 is a sectional view of a corner pad used in the entryway system illustrated by FIG. 1.
Figure 6A:
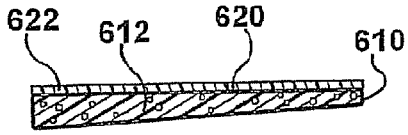
FIGS. 6A and 6B are views of an alternate sectional shape of a corner seal.
Figure 9:
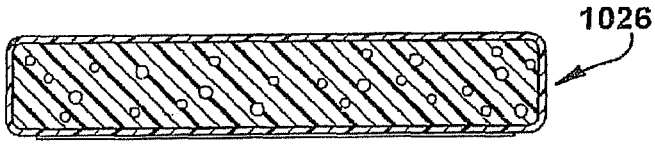
FIG. 9 is a sectional view of embodiment of a corner seal having a generally rectangular cross-section.
Figure 10A:
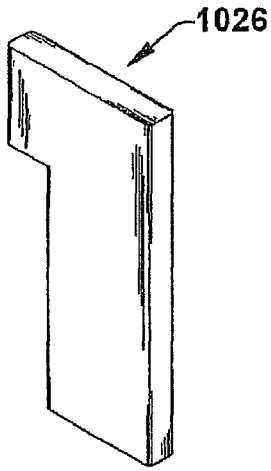
FIGS. 10A and 10B are perspective views of corner seals having the cross-section illustrated by FIG. 9.
Figure 10B:
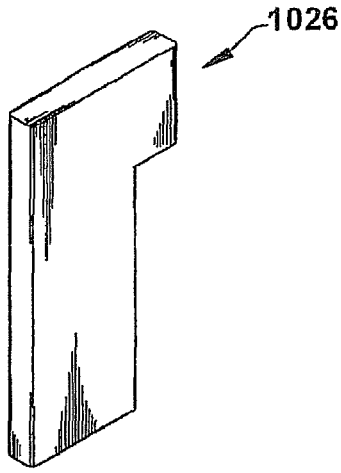
Figure 11:
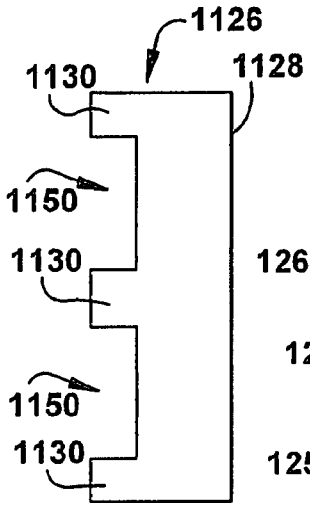
FIG. 11 is a side view of an embodiment of a corner seal.

The corner seal 326 can have a wide variety of different cross-sectional shapes. Any shape that is conducive to sealing with the door 312 can be used. Examples of sectional shapes of the corner seal include, but are not limited to rectangular, oval, tapered, triangular, etc. For example, the corner seal 326 may have the cross-sectional shape shown in FIG. 2, shown in FIG. 6A, or shown in FIG. 9. The shapes illustrated by FIGS. 2 and 6A are slight wedge shapes with a thicker end located adjacent the weather strip and the thinner end located toward the building interior. The shape illustrated by FIG. 2 has rounded ends and the shape illustrated by FIG. 6A has more "squared off" ends. The angle of the wedge may be between about 1 to 20 degrees, for example an angle between 2 and 10 degrees, such as 5 degrees. Further, the wedge shape can be defined by multiple angles and/or contours. The wedge shape facilitates easy closing of the door while providing a tight seal between the door and the corner seal. FIGS. 9, 10A and 10B illustrate an embodiment of a corner seal 1026 that is similar to the corner seal 326, except the corner seal 1026 has a rectangular cross-section.

The corner seal may be made of a soft polymeric foam material having a smooth wear-resistant outer surface or skin 610. The skin 610 may be integrally formed or formed by applying a thin film thereto. In one embodiment, a core 612 of the seal is made of an open cell urethane foam and the outer cover or skin 610 is formed of a low friction polyurethane. The invention is not limited to the specific seal material and other materials such as a self skinning closed cell foam could be used.

The corner pad or seal 326 may be coupled to the door jamb 314 in a wide variety of different ways. The corner seal 326 may be coupled to the door jamb 314 in any manner that holds the corner seal 326 in place as the door 312 is being closed and allows the corner seal 326 to form a seal between the door 312 and the jamb 314 when the door is closed. For example, an adhesive may be provided on the door jamb, an adhesive may be provided on the corner seal, a fastener may attach the seal to the jamb, the corner seal may include a projection that extends into a slot or recess in the door jamb, etc. Referring to FIGS. 5A and 6A, an inner surface 620 of the corner seal 326 which is mounted to the door jamb may be provided with an adhesive layer 622 such as a double coated vinyl foam tape having a high bond strength which is available from a variety of sources such as 3-M "double coated vinyl tape, Model No. 44-16", ADCO "Very high bond acrylic tape, Model AT-1" or Dow Chemical "Foam tape, product code 36736". The selected tape should have very good adhesion characteristics so that the corner seal does not detach from the jamb during long periods of use.

Figure 6B:
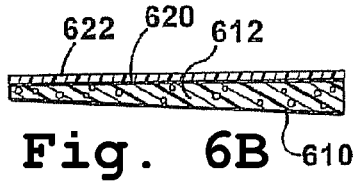
Figure 7B:
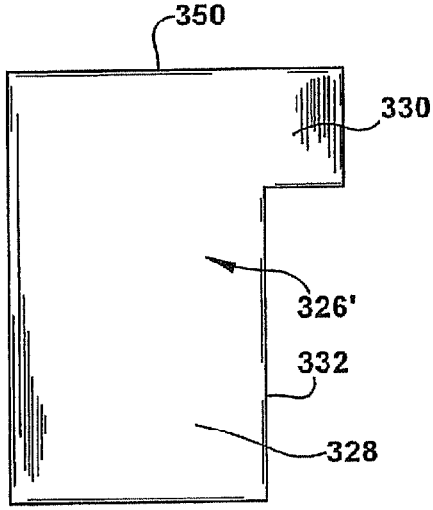
Figure 8B:
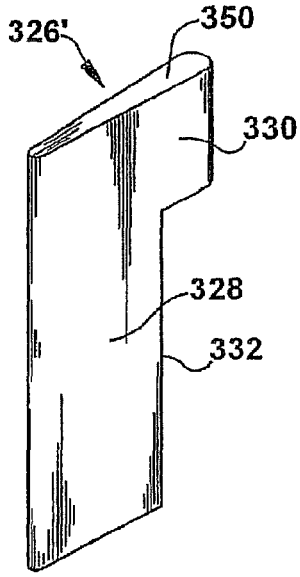

It should be appreciated that the right and left side of the door will require corner seals which are mirror images of one another. A corner seal 326 is illustrated on the left side of the door when viewed from the building exterior. A corner seal 326', shown in FIGS. 6B, 7B and 8B will be placed on the right door jamb in a similar manner.

The corner seal can have a wide variety of different profiles. Any profile can be employed that inhibits flow of water up the channel 325 of the weather strip 319 and over the top surface 350 of the corner seal. FIGS. 11-14 illustrate a few of the many possible corner seal profile alternatives. The corner seal 1126 illustrated by FIG. 11 includes a rectangular body 1128 that is similar to the rectangular body 328 of the corner seal 326. The corner seal 1126 includes three projections 1130 that are similar to the projection 330 of the corner seal 326. Any number of projections can be provided. The corner seal 1126 provides two gaps 1150 between the corner seal 1126 and the weather strip to inhibit flow of water up the weather strip channel. Each projection 1130 also inhibits the flow of water up the weather strip channel.

Figure 12:
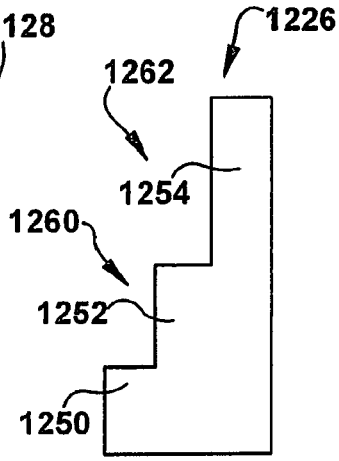
FIG. 12 is a side view of an embodiment of a corner seal.

The corner pad or seal 1226 illustrated by FIG. 12 includes a bottom step 1250, a middle step 1252, and a top step 1254. Any number of steps may be provided. The bottom step 1250 seals with the weather strip in the same or a similar manner that the projection 330 of the corner seal 326 seals with the weather strip. The middle step 1252 is spaced apart from the weather strip to form a gap 1260 between the middle step 1252 and the weather strip. The gap 1260 inhibits movement of water up the channel 325 of the weather strip due to capillary action. The top step 1254 is spaced further apart from the weather strip to form a wider gap 1262 between the corner seal 1126 and the weather strip. The wider gap 1262 further inhibits movement of water up the channel 325 of the weather strip due to capillary action. The corner seal 1226 can also be used in an orientation that is inverted from the orientation shown in FIG. 12.

Figure 13:
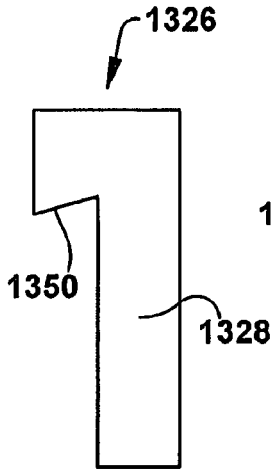
FIG. 13 is a side view of an embodiment of a corner seal.
Figure 14:
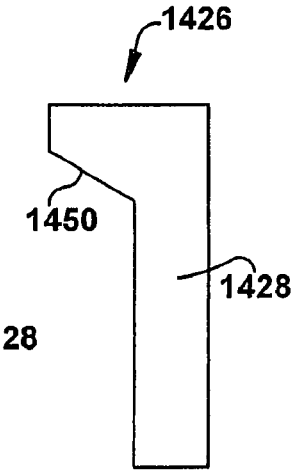
FIG. 14 is a side view of an embodiment of a corner seal.

FIGS. 13 and 14 illustrate examples of corner pads or seals 1326, 1426 that are similar to the corner pads or seals 326, except a projection of each corner seal is tapered. The corner seal 1326 includes a projection lower edge 1350 that extends upward as it extends toward a body portion 1328. The corner seal 1426 includes a projection lower edge 1450 that extends downward as it extends toward the body portion 1428. Any of the horizontal or vertical profile edges of any of the corner seals disclosed herein can be angled or contoured to enhance the corner seals ability to keep water from entering the interior of the building.

Figure 15:
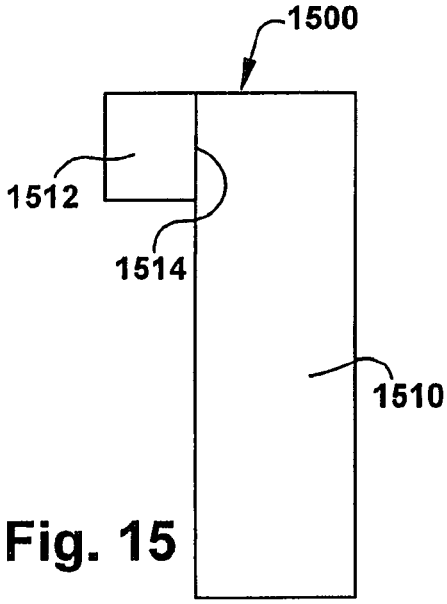
FIG. 15 is a side view of an embodiment of a two-piece corner seal.
Figure 16:
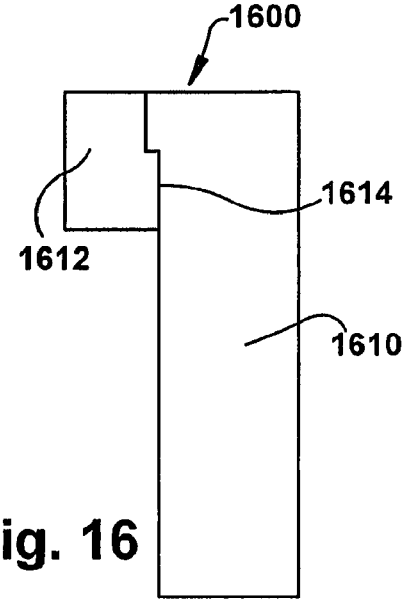
FIG. 16 is a side view of an embodiment of a two-piece corner seal.

The projection or projection(s) of the corner pad or seal may be integrally formed with the body of the corner seal. Referring to FIGS. 15 and 16, a corner seal 1500 may comprise two discrete pads or seal members. The corner seal may include a first pad or seal member 1510 configured to seal with the door 312 and a second pad or seal member 1512 configured to seal with the first pad or seal member 1510 and the weather strip 324. In the example illustrated by FIG. 15, a seal line 1514 between the first pad 1510 and the second pad 1512 is straight. The corner pad 1600 is similar to the corner pad 1500, except a seal line 1614 is stepped to further inhibit water from passing between the first pad 1610 and the second pad 1612.

Figure 17:
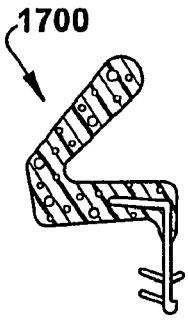
FIG. 17 is a sectional view of an embodiment of a weather strip.
Figure 18:
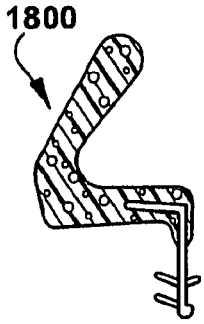
FIG. 18 is a sectional view of an embodiment of a weather strip.
Figure 19:
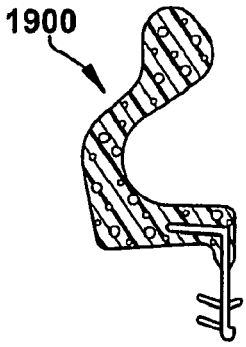
FIG. 19 is a sectional view of an embodiment of a weather strip.

The corner seals described herein can be used with a wide variety of different weather strips. FIGS. 17 through 19 illustrate three examples of weather strips. FIG. 17 illustrates a weather strip 1700 sold by Schlegel under part number TEBD-650. FIG. 18 illustrates a weather strip 1800 sold by Schlegel under part number TEBD-730. FIG. 19 illustrates a weather strip 1900 sold by Schlegel under part number TEBD-928.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An entryway comprising:

a vertical door jamb having a bottom end and a stop extending along the door jamb;

a door hingedly connected to the vertical door jamb;

a weather strip extending along the stop;

a seal positioned at the bottom end of the vertical door jamb, the seal being defined by first, second, and third lateral side edges, the seal including an upper portion and a lower portion, wherein the upper portion is defined by said first and said second lateral side edges, wherein an end of said upper portion extends between said vertical door jamb and said weather strip and seals against the weather strip when the door is closed, wherein said lower portion extends downward from the upper portion, wherein the lower portion is defined by said first lateral side edge and said third lateral side edge that is laterally between said first and second lateral side edges, wherein the lower portion does not extend between said vertical door jamb and said weather strip such that said lower portion is spaced apart from the weather strip to form a gap between the third lateral side edge of the seal and the weather strip, and wherein the lower portion seals against the door when the door is closed.

2. The entryway of claim 1 wherein the gap is larger than a distance that can be spanned by a drop of water.

3. The entryway of claim 1 wherein the seal has a tapered cross-section.

4. The entryway of claim 1 wherein the seal is attached to the door jamb with an adhesive.

5. The entryway of claim 1 wherein the seal is formed of a foam polymer material.

6. The entryway of claim 5 further comprising a polymer film that covers the foam polymer material.

7. The entryway of claim 1 further comprising a tape with adhesive on two sides of said tape that adhesively attaches the seal to the door jamb.

8. The entryway of claim 1 wherein a lower edge of said upper portion is located at least one inch above a lower edge of the lower portion.

9. The entryway of claim 1 wherein a lower edge of said upper portion is located 2 inches to 4 inches above a lower edge of the lower portion.

10. The entryway of claim 1 wherein the seal is attached to the bottom end of the vertical door jamb.

11. A method of providing a seal between a lower end of a door jamb and a lower end of a door while inhibiting water wicking up a channel defined between two legs of a door weather strip mounted to said door jamb comprising:

attaching a corner seal to the door jamb such that an upper portion of the corner seal extends between the door weather strip and the door jamb and a lower portion of the corner seal does not extend between the door jamb and the weather strip such that the lower portion is spaced apart from the weather strip to form a gap between the weather strip and the lower portion that is too large to be spanned by a drop of water;

the corner seal being defined by first, second, and third lateral side edges, wherein the upper portion is defined by said first and said second lateral side edges, wherein said lower portion extends downward from the upper portion, wherein the lower portion is defined by said first lateral side edge and said third lateral side edge that is laterally between said first and second lateral side edges.

12. An entryway comprising:

a vertical door jamb having a bottom end and a stop extending along the door jamb;

a door hingedly connected to the vertical door jamb;

a weather strip extending along the stop;

a seal positioned at the bottom end of the vertical door jamb, the seal being defined by first, second, and third lateral side edges, the seal including an upper portion and a lower portion, wherein the upper portion is defined by said first and said second lateral side edges, wherein an end of said upper portion extends between said vertical door jamb and said weather strip and seals against the weather strip when the door is closed, wherein said lower portion extends downward from the upper portion, wherein the lower portion is defined by said first lateral side edge and said third lateral side edge that is laterally between said first and second lateral side edges, wherein said third lateral side edge extends from said upper portion to a bottommost surface of the seal, wherein the lower portion does not extend between said vertical door jamb and said weather strip such that said lower portion is spaced apart from the weather strip to form a gap between the third lateral side edge of the seal and the weather strip, and wherein the seal seals against the door when the door is closed.

13. The entryway of claim 12 wherein the gap is larger than a distance that can be spanned by a drop of water.

14. The entryway of claim 12 wherein a lower edge of said upper portion is located 2 inches to 4 inches above said bottommost surface of the seal.

15. The entryway of claim 12 wherein the seal has a tapered cross-section.

16. The entryway of claim 12 wherein the seal is attached to the door jamb with an adhesive.

17. The entryway of claim 12 wherein the seal is formed of a foam polymer material.

18. The entryway of claim 17 further comprising a polymer film that covers the foam polymer material.

19. The entryway of claim 12 further comprising a tape with adhesive on two sides of said tape that adhesively attaches the seal to the door jamb.

20. The entryway of claim 12 wherein a lower edge of said upper portion is located at least one inch above said bottommost surface of the seal.

21. The entryway of claim 12 wherein a lower edge of said upper portion is located above said bottommost surface of the seal.

* * * * *